US007581356B1

(12) United States Patent
Balkum et al.

(10) Patent No.: US 7,581,356 B1
(45) Date of Patent: Sep. 1, 2009

(54) GUTTER SHIELD

(76) Inventors: Frank R. Balkum, 37 Ferncrest Dr., Pawtucket, RI (US) 02861; Jose Silveira, 9 Bradley St., Pawtucket, RI (US) 02861

( * ) Notice: Subject to any disclaimer, the term of this patent is extended or adjusted under 35 U.S.C. 154(b) by 169 days.

(21) Appl. No.: 11/827,057

(22) Filed: Jul. 10, 2007

Related U.S. Application Data

(60) Provisional application No. 60/834,581, filed on Aug. 1, 2006.

(51) Int. Cl.
*E04D 13/00* (2006.01)

(52) U.S. Cl. ..... 52/12; 52/11; 52/15

(58) Field of Classification Search ..... 52/11–16
See application file for complete search history.

(56) References Cited

U.S. PATENT DOCUMENTS 538,108 A * 4/1895 Freeze ..... 52/11
2,072,415 A 3/1937 Abbitt
4,032,456 A * 6/1977 Berce ..... 210/474
4,351,134 A 9/1982 Clarkson
4,407,097 A 10/1983 Allen
4,998,386 A 3/1991 Baumgarth
5,056,276 A * 10/1991 Nielsen et al. ..... 52/12
5,457,916 A * 10/1995 Tenute ..... 52/12
5,495,694 A * 3/1996 Kuhns ..... 52/12
5,640,809 A * 6/1997 Iannelli ..... 52/12
5,640,810 A * 6/1997 Pietersen ..... 52/12
5,752,347 A * 5/1998 Osborn ..... 52/11
5,867,945 A 2/1999 Scafidi
5,875,590 A * 3/1999 Udelle ..... 52/16
5,989,357 A * 11/1999 Vilhauer et al. ..... 134/8
6,240,679 B1 * 6/2001 Smalara ..... 52/16
6,314,685 B1 * 11/2001 Sullivan ..... 52/12
6,708,452 B1 * 3/2004 Tenute ..... 52/11
6,904,718 B2 * 6/2005 Fox ..... 52/12
7,334,369 B2 * 2/2008 Carson ..... 52/11
2002/0069594 A1 * 6/2002 Sweet ..... 52/12
2002/0152692 A1 * 10/2002 Bahroos et al. ..... 52/11
2003/0029129 A1 * 2/2003 Walters ..... 52/741.1
2004/0031209 A1 * 2/2004 Porter ..... 52/12
2005/0097826 A1 * 5/2005 Fox ..... 52/12
2006/0075689 A1 * 4/2006 Hawash ..... 52/12
2006/0107603 A1 * 5/2006 Brownridge ..... 52/11
2006/0196124 A1 * 9/2006 Bachman ..... 52/12
2006/0225367 A1 * 10/2006 Stagni ..... 52/11
2006/0265968 A1 * 11/2006 Lowrie ..... 52/11
2006/0277831 A1 * 12/2006 Bachman ..... 52/11
2007/0125005 A1 * 6/2007 Carson ..... 52/11

* cited by examiner

*Primary Examiner*—Richard E Chilcot, Jr.
*Assistant Examiner*—Andrew J Triggs
(74) *Attorney, Agent, or Firm*—Salter & Michaelson

(57) ABSTRACT

A gutter shield is disclosed that is for inhibiting debris from entering a gutter while allowing water flow to the gutter. The gutter shield includes a plate member having a top edge for engagement with a roof shingle and having a lower edge for engagement with an outer side of the gutter. The plate member has a series of holes therethrough that enable water to flow through the holes to the gutter therebelow. The gutter shield also includes a cover on the plate member that has open and closed positions, the cover being in the open position to enable access to the gutter for cleaning purposes and being in the closed position to enable water to flow over the cover and a hinge to enable the cover to be moved between open and closed positions thereof.

18 Claims, 9 Drawing Sheets

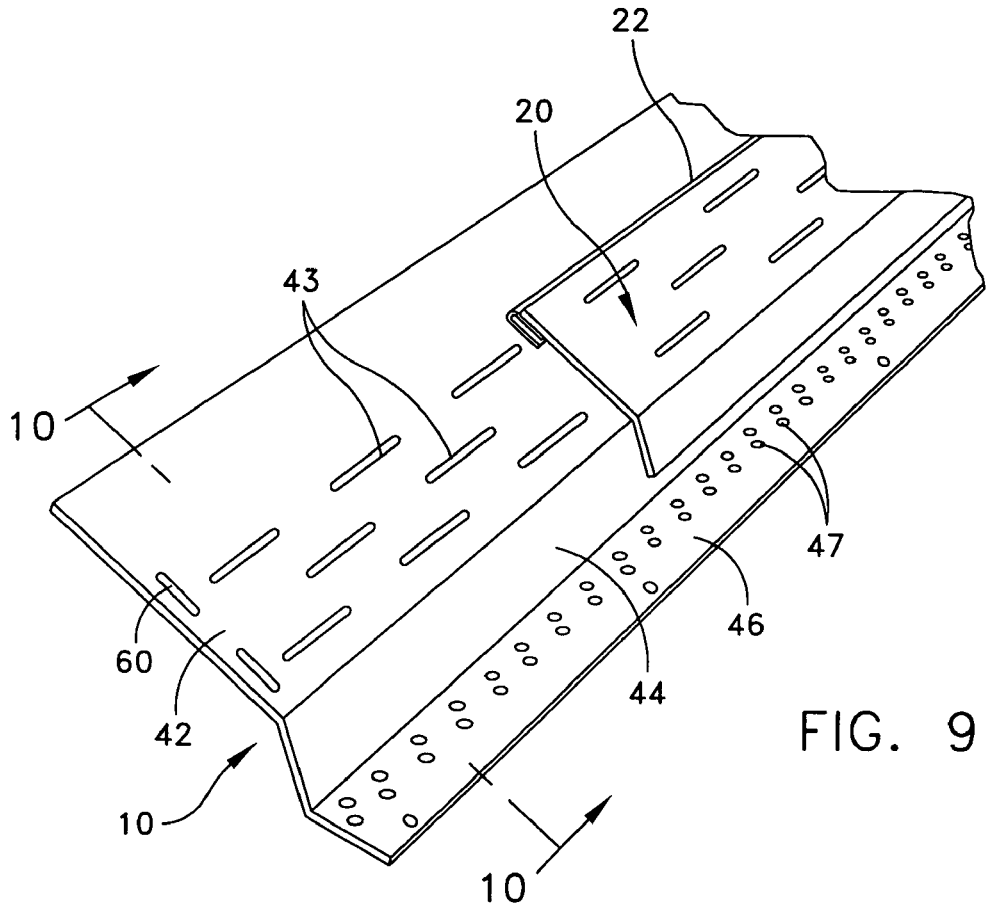
FIG. 9
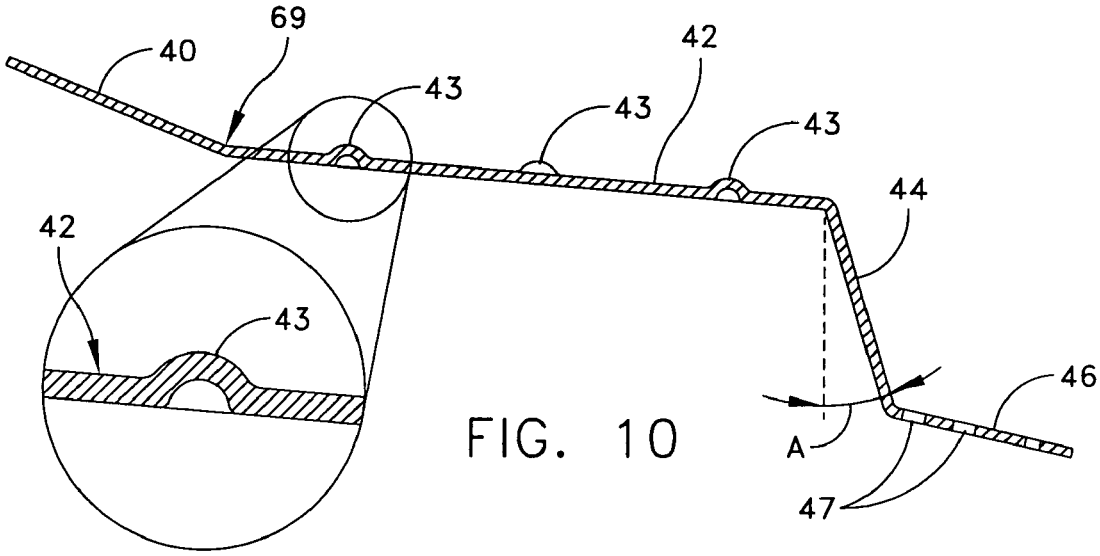
FIG. 10
FIG. 11

GUTTER SHIELD

RELATED CASES

Priority for this application is hereby claimed under 35 U.S.C. § 119(e) to commonly owned and co-pending U.S. Provisional Patent Application No. 60/834,581 which was filed on Aug. 1, 2006 and which is incorporated by reference herein in its entirety.

TECHNICAL FIELD

The present invention relates in general to a gutter shield that is used on a standard gutter for preventing leaves and other debris from entering the gutter. More particularly, the invention pertains to an improved gutter guard or gutter shield that can be easily installed and the gutter easily cleaned.

BACKGROUND DISCUSSION

There are numerous existing patents that show various types of gutter protectors such as illustrated in U.S. Pat. Nos. 2,072,415; 4,032,456 and 4,351,134. One of the drawbacks with existing gutter shield constructions is that they still allow too much debris to enter the gutter. Moreover, with existing gutter protectors there is no effective and easy way of cleaning the gutter without removing the gutter protector. Another drawback to existing gutter shields is that they need to be attached to the roofing and thus possibly create an additional problem of leaks at the attachment points.

Accordingly, it is an object of the present invention to provide an improved gutter shield that blocks most debris preventing it from entering the gutter and yet also provides a convenient means for cleaning out the gutter.

A further object of the present invention is to provide an improved gutter shield that blocks most debris preventing it from entering the gutter and includes means to clean out the gutter without having to dismantle the gutter shield.

Still another object of the present invention is to provide an improved gutter shield that does not require that the shield be fastened to the roofing.

BRIEF SUMMARY OF THE INVENTION

To accomplish the foregoing and other objects, features and advantages of the invention, there is provided a gutter shield that is easily installed at the edge of the roof over the gutter and that blocks the majority of leaves and debris that might otherwise accumulate in the gutter. At the same time, the gutter shield of the present invention allows water to flow to a row of perforations thus allowing the water to flow into the gutter.

In accordance with another aspect of the present invention the gutter shield is provided with a hinged cover or lid to allow easy cleaning of the gutter such as with a garden hose. In accordance with a further aspect of the present invention the gutter shield preferably includes a staggered ridge arrangement that provides some limited diversion of the water as it flows from the roof toward the perforations. In accordance with another aspect of the present invention the gutter shield is provided in predetermined lengths that can be interlocked one to the other. Each length may or may not include a hinged lid for clean-out purposes.

In one embodiment of the present invention there is provided a gutter shield that is for inhibiting debris from entering a gutter while allowing water flow to the gutter, said gutter shield comprising, a plate member having a top edge for engagement with a roof shingle and having a lower edge for engagement with an outer side of the gutter; the plate member having a series of holes therethrough that enable water to flow through the holes to the gutter therebelow; a cover on the plate member that has open and closed positions; the cover being in the open position to enable access to the gutter for cleaning purposes and being in the closed position to enable water to flow over the cover and a hinge to enable the cover to be moved between open and closed positions thereof.

In accordance with other features of the present invention the plate member may include at least a top section that is meant to be disposed under the shingles and a base section that has the holes therein; the plate member may also include an intermediate section that interconnects the top and base sections forming a step therebetween; the intermediate section may extend at an angle of less than 45 degrees to the normal of the top section or at an angle less than 30 degrees; the plate member may include a reversed section including a portion that overlies the base section; the plate member may have diverters that re-direct water flow; the plate member may have end ridges for interlocking between separate sections of the gutter shield; fasteners may be provided for securing the base section to an edge of the gutter and the fasteners may be the only means of securing the gutter shield to the gutter or roof shingles.

Also in accordance with the invention there is provided a gutter shield that is for inhibiting debris from entering a gutter while allowing water flow to the gutter, said gutter shield comprising: a plate member having a top edge for engagement with a roof shingle and having a lower edge for engagement with an outer side of the gutter; the plate member having a series of holes therethrough that enable water to flow through the holes to the gutter therebelow; wherein the plate member includes at least a top section that is meant to be disposed under the shingles and a base section that has the holes therein; and including fasteners for securing the base section to an edge of the gutter.

In accordance with still other features of the present invention the plate member the fasteners may be the only means of securing the gutter shield to the gutter or roof shingles; the gutter shield may further include a cover on the plate member that has open and closed positions, the cover being in the open position to enable access to the gutter for cleaning purposes and being in the closed position to enable water to flow over the cover, and a hinge to enable the cover to be moved between open and closed positions thereof; wherein the plate member may also include an intermediate section that interconnects the top and base sections forming a step therebetween; wherein the intermediate section may extend at an angle of less than 45 degrees to the normal of the top section; wherein the plate member may include a reversed section including a portion that overlies the base section; wherein the plate member may have diverters that re-direct water flow; and wherein the plate member may have end ridges for interlocking between separate sections of the gutter shield.

Also in accordance with the invention there is provided a gutter shield that is for inhibiting debris from entering a gutter while allowing water flow to the gutter, said gutter shield comprising: a plate member having a top edge for engagement with a roof shingle and having a lower edge for engagement with an outer side of the gutter; the plate member having a series of holes therethrough that enable water to flow through the holes to the gutter therebelow; wherein the plate member includes at least a top section that is meant to be disposed under the shingles and a base section that has the holes therein; and wherein the plate member includes a reversed section including a portion that overlies the base section

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which:

FIG. 9 is a fragmentary perspective view illustrating the end interlocking of the gutter shield;

FIG. 10 is a cross-sectional view through the gutter shield illustrating the diverters;

FIG. 11 is an enlarged fragmentary cross-sectional view of one of the diverters of FIG. 10;

DETAILED DESCRIPTION

Figure 12:
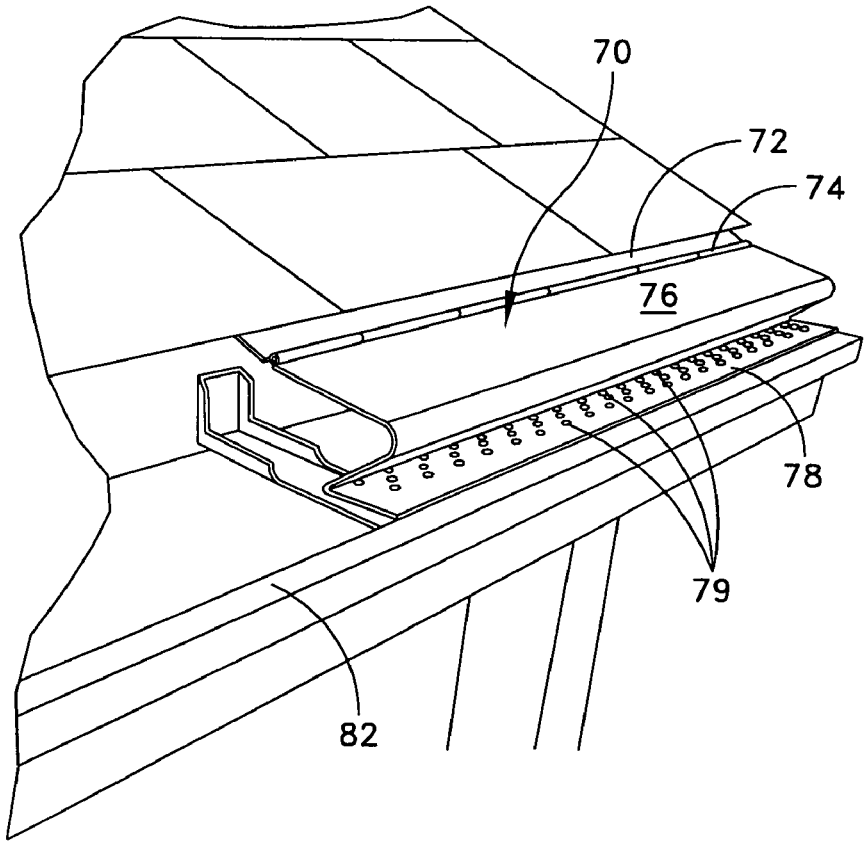
FIG. 12 is a fragmentary perspective view of an alternate embodiment of the gutter shield of the present invention.
Figure 13:
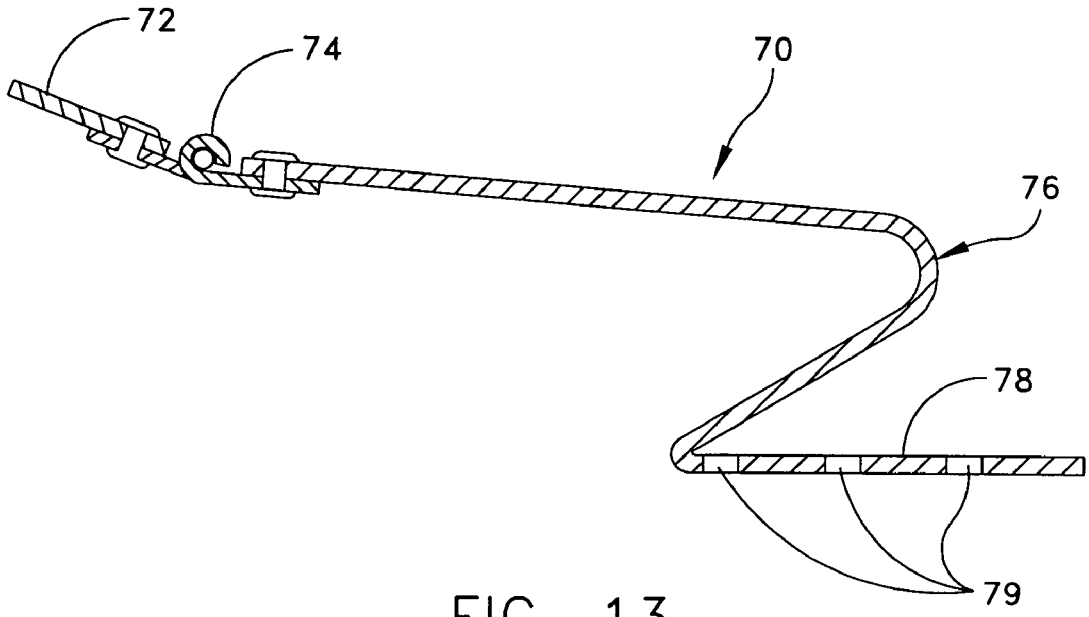
FIG. 13 is a cross-sectional view taken transversely through the gutter shield illustrated in FIG. 12.

A first embodiment of the present invention is illustrated in FIGS. 1-11. An alternate embodiment is shown in FIGS. 12 and 13.

Figure 1:
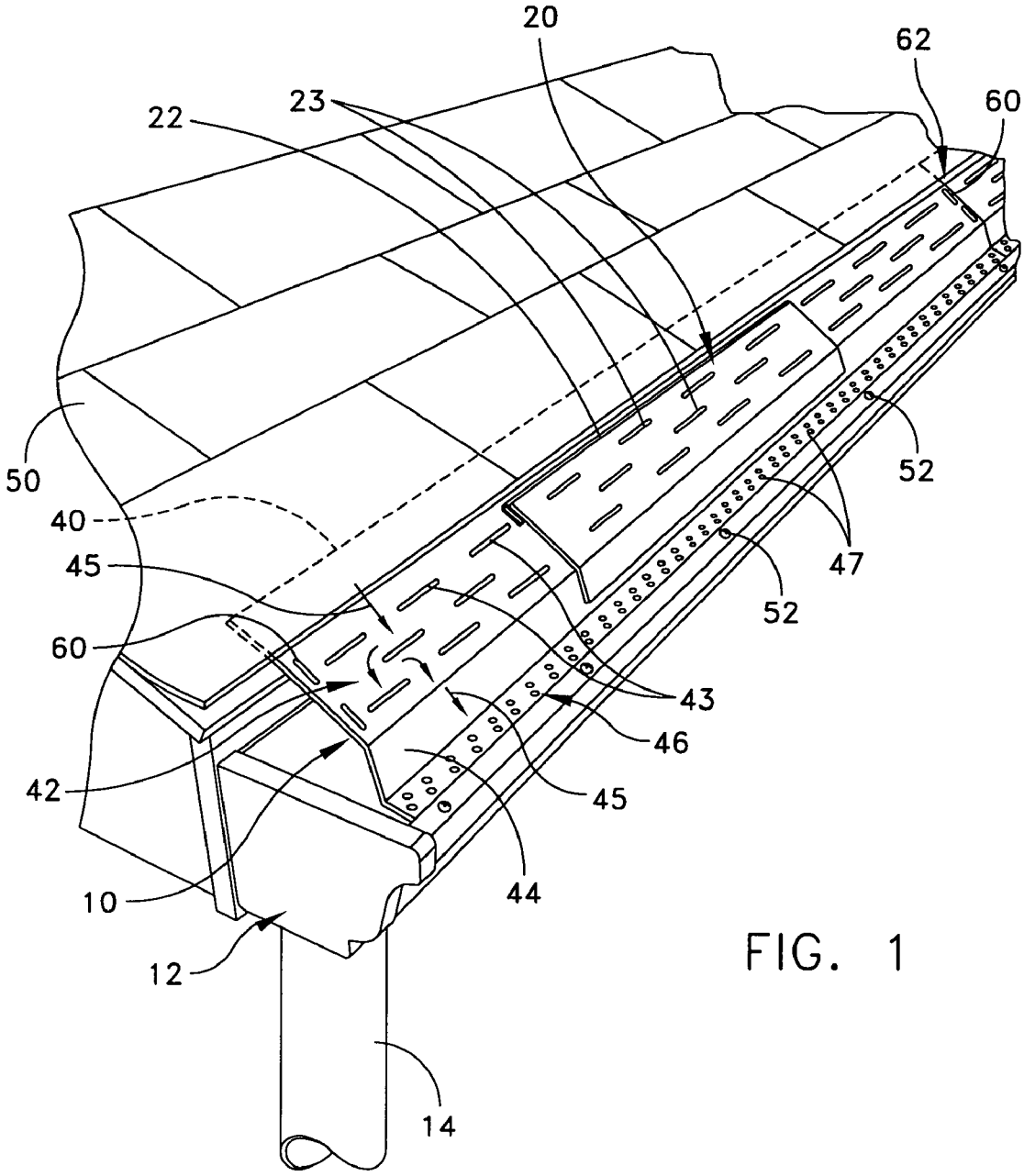
FIG. 1 is a perspective view of a first embodiment of the present invention incorporating a lid or cover for clean-out purposes.
Figure 2:
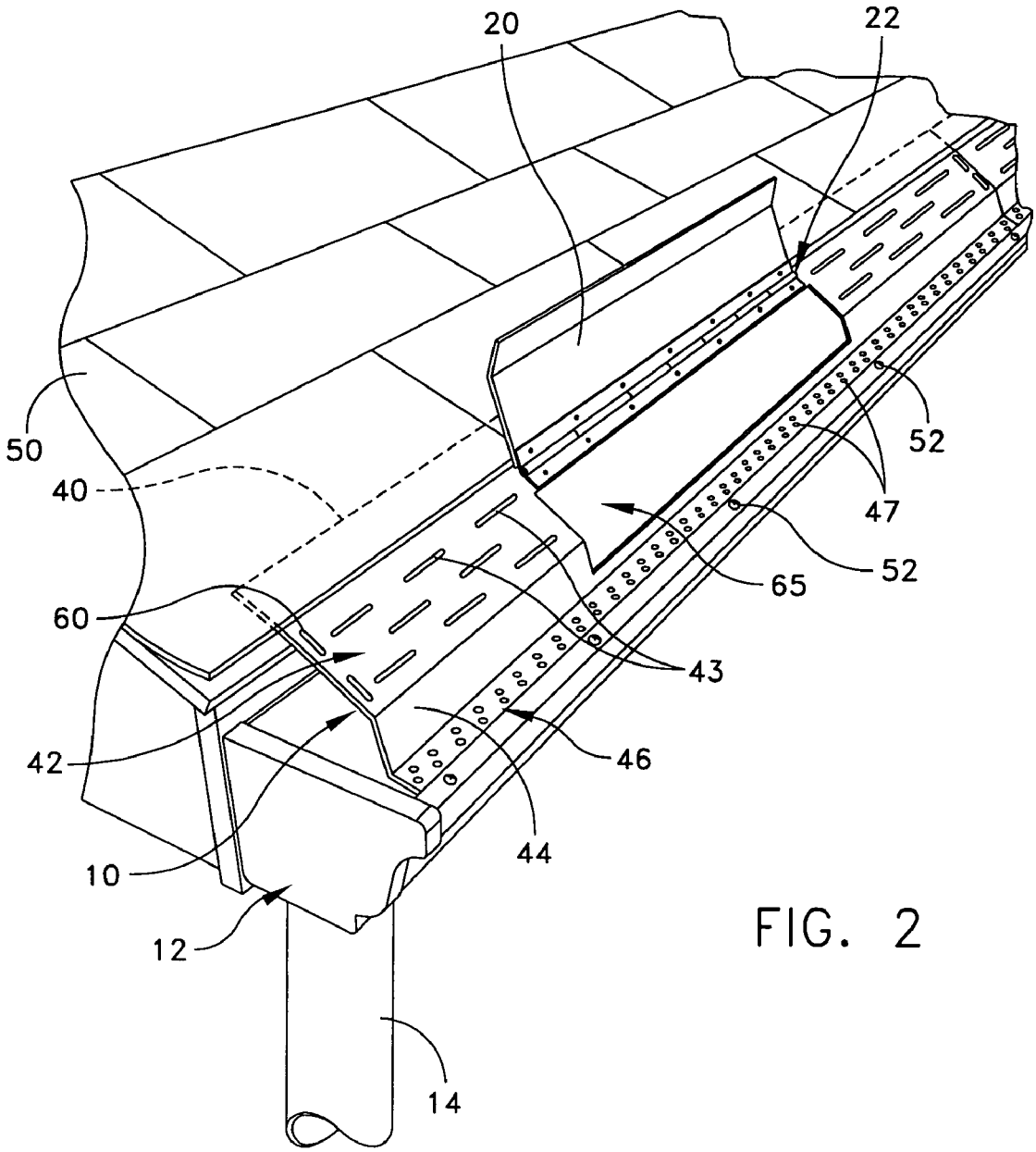
FIG. 2 is a perspective view of the gutter shield of FIG. 1 showing the lid or cover in an open position.
Figure 3:
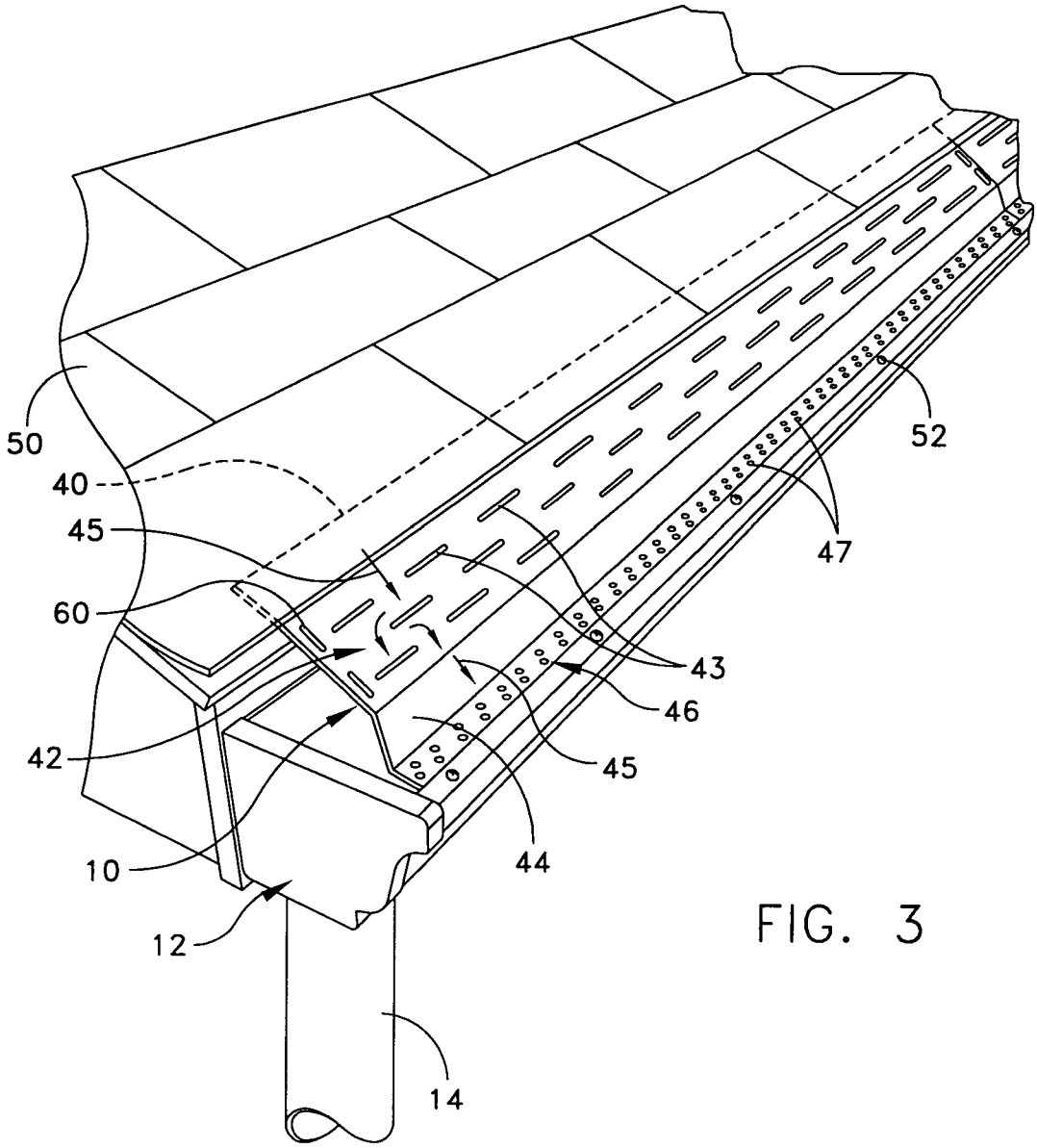
FIG. 3 is a perspective view of the gutter shield in a section that does not include the lid or cover.
Figure 4:
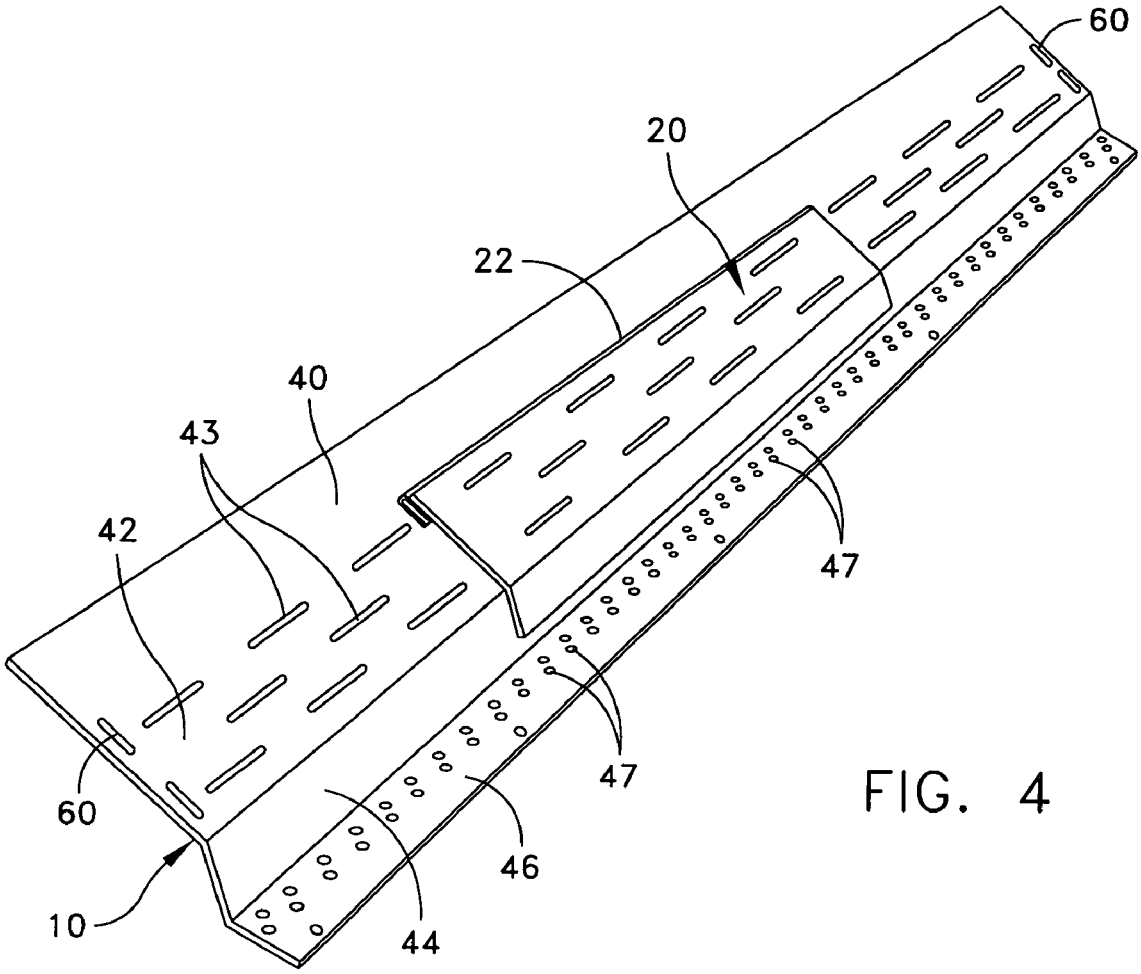
FIG. 4 is a perspective view of the gutter shield alone depicted in FIG. 1.
Figure 5:
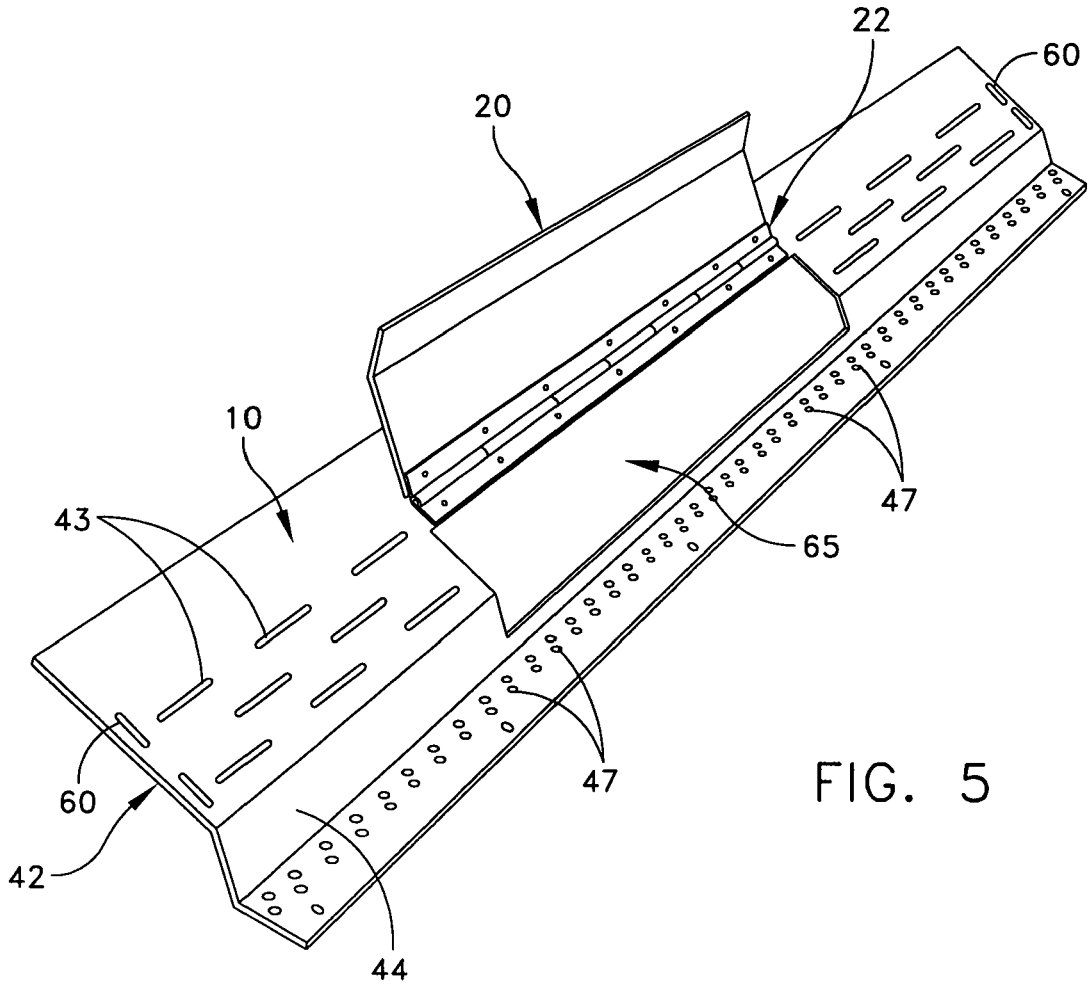
FIG. 5 is a perspective view of the gutter shield of FIG. 4 with the lid or cover opened.
Figure 7:
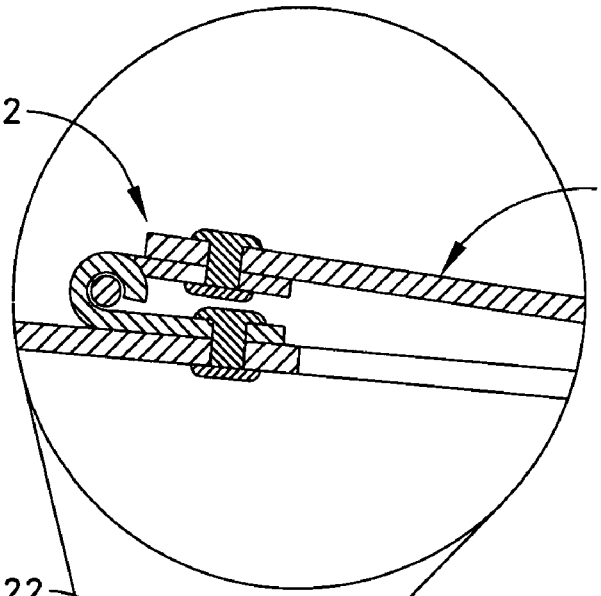
FIG. 7 is an enlarged cross-sectional fragmentary view showing the hinge arrangement for the cover or lid.

In the first embodiment of the present invention there is shown a gutter shield 10 that is illustrated as disposed over the gutter 12. FIGS. 1 and 2 also illustrate a down spout 14 extending from the gutter 12. In the perspective view of FIG. 1, associated with the gutter shield 10, is a lid or cover 20 that is hinged to the gutter shield by means of a conventional hinge 22 (see FIG. 5). The gutter shield and cover may both be constructed of a light weight metal such as aluminum, or could be constructed of a plastic material.

The gutter shield 10 is illustrated in FIG. 1 as provided in separate lengths of, for example, four feet and each may or may not be provided with a clean out cover or lid 20. The embodiment illustrated in FIGS. 1 and 2 may be considered as illustrating a four foot section with the clean out cover 20. The embodiment illustrated in FIG. 3 includes a four foot section without any clean out cover. For a long length of gutter, one may use the sections with the clean out cover at either end of the gutter shield arrangement and provide intermediate gutter sections that do not use the cover therein. A normal length gutter can be cleaned with a hose from either or both ends.

In either of the embodiments, the gutter shield 10 is comprised of preferably three separate sections, or as illustrated in the cross-sectional view of FIG. 10 four separate sections. These include a top edge section 40 that is adapted to be disposed under at least one course of shingles 50. The gutter shield 10 also includes a main top section 42 that the water rolls over as illustrated by the arrows 45 in FIGS. 6 and 8. As noted in FIG. 10 the sections 40 and 42 are disposed at a slightly different angle one to the other. The flat section 42 is also preferably provided with diverters 43 that are shown in a cross-section in FIG. 10. These diverters run in the same direction as illustrated in FIG. 1 but are staggered from one row to the next. Each diverter may be in the form of a raised ridge. The cover or lid 20 is also preferably provided with flow diverters 23 of a similar configuration to that described in FIG. 10. This provides some limited interruption to the water flow so as to reduce splashing as the water flows over the gutter shield surface.

Figure 6:
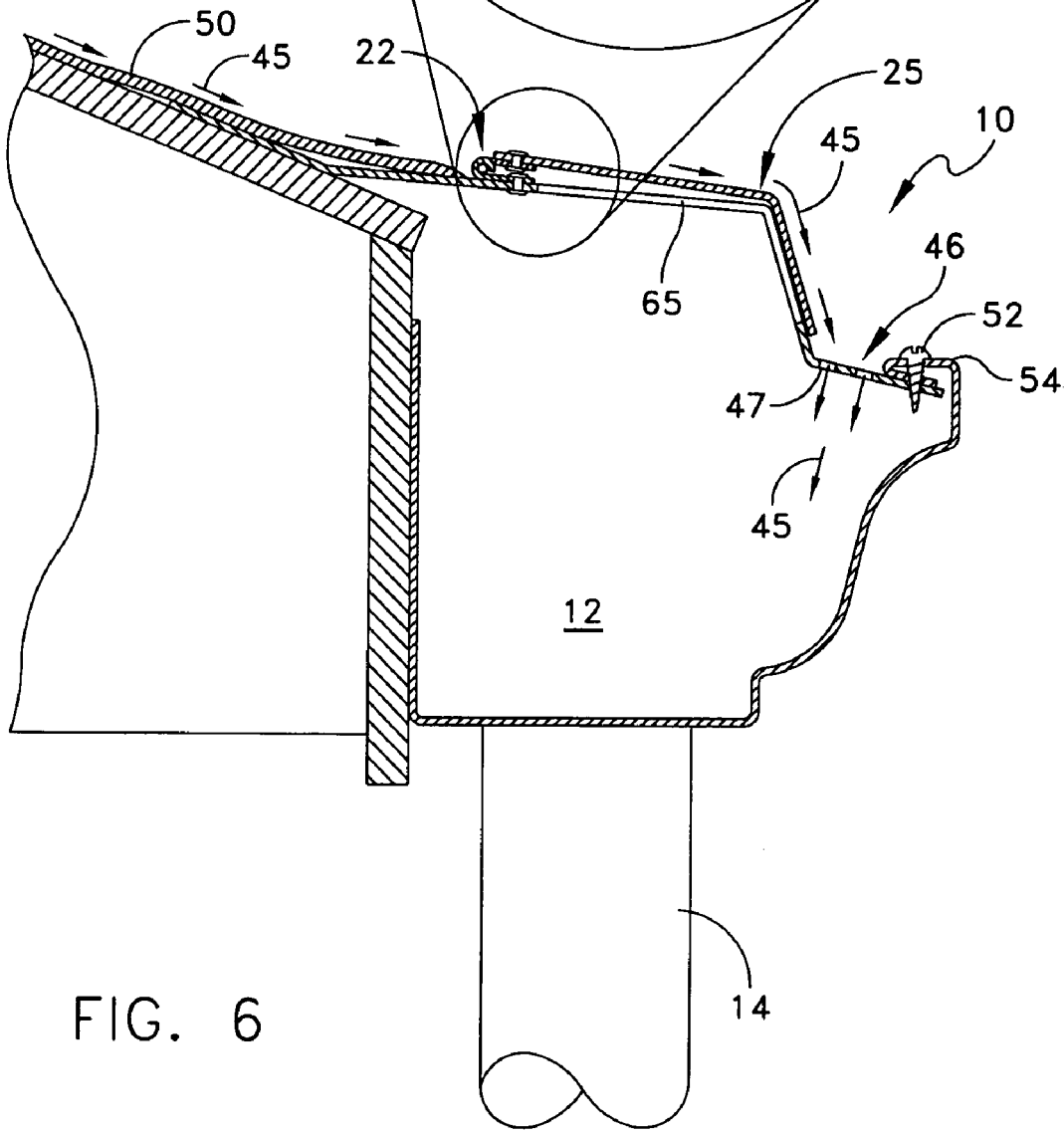
FIG. 6 is a cross-sectional view taken transversely through the gutter shield illustrated in FIG. 1.

The gutter shield 10 also includes a contiguous intermediate section 44 and a lower terminating section 46. It is the lower flat section 46 that is provided with a series of holes or perforations 47 through which the water flows into the gutter. Refer to the cross-sectional view of FIG. 6 shown by means of arrows 45 the water flow into the gutter 12 through the perforations 47. Preferably, a series of perforations as illustrated in FIG. 1 extend along the entire lower section 46. The perforations or holes 47 are shown disposed in two side-by-side rows. The section 42, as illustrated in FIG. 10, is disposed at a rather sharp angle "A" relative to the normal line to the section 42. This is preferred so that, while the water flows downwardly, the leaves or other debris tends to be expelled away from the gutter shield falling toward the ground. The angle "A" is less than 45 degree and preferably is less than 30 degrees.

The gutter shield, as indicated previously, extends at its top end under a course of shingles. Because the gutter shield is preferably secured at its lower edge, it is noted that the top edge that is inserted under the shingles does not require any securing means such as screws or the like. This is helpful in preventing water leaks that might occur if securing means are used. At its lower end, such as illustrated in FIGS. 1, 2 and 6 there are provided a series of spacedly disposed machine screws 52 that are used to secure the lower section 46 with the edge 54 of the gutter. FIG. 6 shows the screw 52 attaching the section 46 at its edge to the edge 54 of the gutter with the edge of section 46 under the gutter edge. In an alternate arrangement the edge of the section 46 may be attached by the screw 52 over the gutter edge 54. The gutter typically is an aluminum or other lightweight metal material and the machine screw 52 is readily drilled through the edge of the gutter and into the gutter shield to secure the gutter shield in place. With this as the primary securing location it is noted that there is no requirement that the gutter shield be attached at the top of the section 40. The shingles are sufficient to hold the top end of the gutter shield in place.

Another feature of the gutter shield of the present invention is the provision of ribs 60 at opposite ends of each section of the shield. The ribs 60 extend orthogonal to the diverters 43 and enable an interlocking between each of the four foot sections of gutter shield. FIG. 1 illustrates two sections being interlocked at 62. For this purpose, each section of the gutter shield may slightly overlap the adjacent section with the end ridges interlocking with each other.

Figure 8:
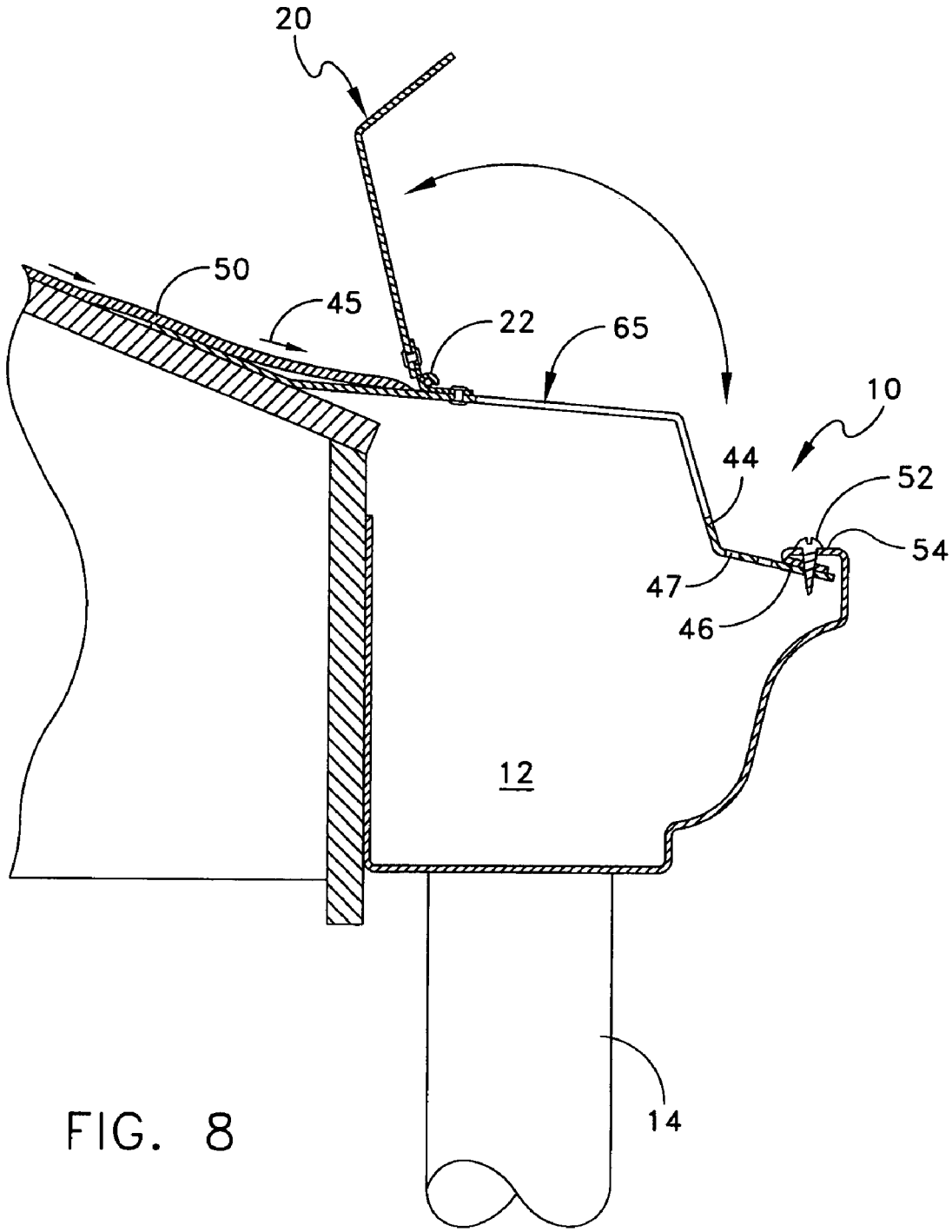
FIG. 8 is a cross-sectional view similar to that shown in FIG. 6 but with the lid or cover in an open position for the purpose of providing access to the gutter.

In the embodiment illustrated in FIGS. 1 and 2 where there is a cover 20 provided, it is noted that the gutter shield, at sections 42 and 44 is provided with an opening 65 that the cover 20 covers. In this regard also refer to the cross-sectional view of FIG. 8 that shows the opening 65 with the cover 20 in its open position. The cross-sectional view of FIG. 6 illustrates the cover 20 closed over the opening 65. In the closed position water can run over the cover and toward the perforations 47. The cover 20 is normally moved to its open position as illustrated in FIG. 8 for the purpose of cleaning out the gutter such as by inserting a hose into the gutter to clean out any remaining debris that might accumulate in the gutter. The cover 20 is useful in enabling the gutter to be easily cleaned so that accumulated debris, mold and/or mildew can be removed without requiring that the structure be dismanted.

A further embodiment of the present invention, similar to that illustrated in FIGS. 1-11 may also include an arrangement in which the entire shield is hinged such as at the location 69 indicated in FIG. 10. In that instance, then the door 20 illustrated in FIG. 9 is not necessary but instead the entire four foot section is hinged so that it can be lifted and the gutter can be cleaned out. Preferably the end four foot sections are provided with such a hinge while the middle sections may be provided with no hinge. This enables one to have access at the opposite ends of the gutter by way of this hinge arrangement. Refer also to FIGS. 12 and 13 which illustrate the use of a hinge 74 for hinging the entire gutter shield or gutter shield section.

Reference is now made to FIGS. 12 and 13 for a further embodiment of the present invention. This illustrates a gutter shield 70 that has a reversed section as shown in the cross-sectional view of FIG. 13. This arrangement is particularly advantageous in providing a means for accommodating water flow while at the same time extending the shield so that the leaves or other debris tend to be expelled away from the gutter shield falling toward the ground. Refer to the cross-sectional view of FIG. 13 that shows the overhang of the reversed section relative to the base section of the gutter shield.

In the embodiment of the present invention shown in FIGS. 12 and 13 there is provided a top section 72 that may be disposed under at least one course of shingles without having to be fastened at the shingle end. This embodiment is also provided with a hinge 74 that enables the entire remainder of the gutter shield to be pivoted upwardly to an open position for cleaning or to a closed position for normal use. The hinge 74 connects to the reversed section 76 and downwardly to the base or lower section 78. Section 78 may be substantially horizontally disposed in use and is provided with a plurality of holes or perforations 79. The perforations may be provided in a pattern similar to that shown in the first embodiment herein. However, in this embodiment the number of perforations are disposed in three rows rather than the two rows shown in the first embodiment.

In the embodiment shown in FIGS. 12 and 13 the gutter shield is illustrated as hinged at 74. To avoid screws being placed through the roofing, temporary screws may be used to secure the lower edge of the gutter shield to the edge of the gutter as in the first embodiment described herein. If fasteners are used through the roofing then the lower edge of the gutter shield need only rest on the top of the gutter edge. In this second embodiment the gutter shield may also be provided with diverters and interlock ribs as previously described in connection with the first embodiment. Moreover, in place of the hinge 74 this embodiment may use a separate cover or lid as in the first embodiment for cleaning out the gutter.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A gutter shield that is for inhibiting debris from entering a gutter while allowing water flow to the gutter, said gutter shield comprising:

a plate member having a top edge for engagement with a roof shingle and having a lower edge for engagement with an outer side of the gutter;

said plate member having a series of holes therethrough that enable water to flow through the holes to the gutter therebelow;

a cover on the plate member that has open and closed positions;

said cover being in the open position to enable access to the gutter for cleaning purposes and being in the closed position to enable water to flow over the cover;

and a hinge to enable the cover to be moved between open and closed positions thereof.

2. The gutter shield of claim 1 wherein said plate member includes at least a top section that is meant to be disposed under the shingles and a base section that has the holes therein.

3. The gutter shield of claim 2 wherein the plate member also includes an intermediate section that interconnects the top and base sections forming a step therebetween.

4. The gutter shield of claim 3 wherein the intermediate section extends at an angle of less than 45 degrees to the normal of the top section.

5. The gutter shield of claim 4 wherein the angle is less than 30 degrees.

6. The gutter shield of claim 2 wherein the plate member includes a reversed section including a portion that overlies the base section.

7. The gutter shield of claim 1 wherein the plate member has diverters that re-direct water flow.

8. The gutter shield of claim 1 wherein the plate member has end ridges for interlocking between separate sections of the gutter shield.

9. The gutter shield of claim 2 including fasteners for securing the base section to an edge of the gutter.

10. The gutter shield of claim 9 wherein the fasteners are the only means of securing the gutter shield to the gutter or roof shingles.

11. A gutter shield that is for inhibiting debris from entering a gutter while allowing water flow to the gutter, said gutter shield comprising:

a plate member having a top edge for engagement with a roof shingle and having a lower edge for engagement with an outer side of the gutter;

said plate member having a series of holes therethrough that enable water to flow through the holes to the gutter therebelow;

wherein said plate member includes at least a top section that is meant to be disposed under the shingles and a base section that has the holes therein;

and including fasteners for securing the base section to an edge of the gutter;

further including;

a cover on the plate member that has open and closed positions, said cover being in the open position to enable access to the gutter for cleaning purposes and being in the closed position to enable water to flow over the cover, and a hinge to enable the cover to be moved between open and closed positions thereof.

12. The gutter shield of claim 11 wherein the fasteners are the only means of securing the gutter shield to the gutter or roof shingles.

13. The gutter shield of claim 11 wherein the plate member also includes an intermediate section that interconnects the top and base sections forming a step therebetween.

14. The gutter shield of claim 13 wherein the intermediate section extends at an angle of less than 45 degrees to the normal of the top section.

15. The gutter shield of claim 11 wherein the plate member includes a reversed section including a portion that overlies the base section.

16. The gutter shield of claim 11 wherein the plate member has diverters that re-direct water flow.

17. The gutter shield of claim 11 wherein the plate member has end ridges for interlocking between separate sections of the gutter shield.

18. A gutter shield that is for inhibiting debris from entering a gutter while allowing water flow to the gutter said gutter shield comprising:

a plate member having a top edge for engagement with a roof shingle and having a lower edge for engagement with an outer side of the gutter;

said plate member having a series of holes therethrough that enable water to flow through the holes to the gutter therebelow;

wherein said plate member includes at least a top section that is meant to be disposed under the shingles and a base section that has the holes therein;

and wherein the plate member includes a reversed section including a portion that overlies the base section;

further including;

a cover on the plate member that has open and closed positions, said cover being in the open position to enable access to the gutter for cleaning purposes and being in the closed position to enable water to flow over the cover, and a hinge to enable the cover to be moved between open and closed positions thereof.

* * * * *